US008793840B2

(12) United States Patent
Schwarz et al.

(10) Patent No.: US 8,793,840 B2
(45) Date of Patent: Aug. 5, 2014

(54) METHOD AND DEVICE FOR THE DRY FORMING OF A FIBER WEB

(71) Applicant: Oerlikon Textile GmbH & Co. KG, Remscheid (DE)

(72) Inventors: Olaf Schwarz, Neumunster (DE); Ingo Mahlmann, Itzehoe (DE); Rune Sogaard Jensen, Horsens (DK)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 13/775,721

(22) Filed: Feb. 25, 2013

(65) Prior Publication Data

US 2013/0175737 A1 Jul. 11, 2013

Related U.S. Application Data

(63) Continuation-in-part of application No. PCT/EP2011/064659, filed on Aug. 25, 2011.

(30) Foreign Application Priority Data

Aug. 31, 2010 (DE) ..... 10 2010 035 944

(51) Int. Cl.

| | |
|---|---|
| ***D04H 1/00*** | (2006.01) |
| ***D04H 1/736*** | (2012.01) |
| ***D04H 1/732*** | (2012.01) |
| ***D01G 25/00*** | (2006.01) |
| ***D04H 1/74*** | (2006.01) |

(52) U.S. Cl.

CPC ..... *D04H 1/005* (2013.01); *D04H 1/736* (2013.01); *D04H 1/732* (2013.01); *D01G 25/00* (2013.01); *D04H 1/74* (2013.01)

USPC ..... 19/304; 19/296

(58) Field of Classification Search

USPC ..... 19/144, 296, 304, 307, 308; 425/224; 264/109, 121

See application file for complete search history.

(56) References Cited

U.S. PATENT DOCUMENTS

| | | | | |
|---|---|---|---|---|
| 3,792,943 | A | 2/1974 | Helgesson | |
| 4,375,447 | A * | 3/1983 | Chung | 264/518 |

(Continued)

FOREIGN PATENT DOCUMENTS

| | | |
|---|---|---|
| DE | 2149892 | 4/1972 |
| WO | WO 03/016605 | 2/2003 |

(Continued)

OTHER PUBLICATIONS

PCT/EP2011/064659 International Search Report dated Oct. 20, 2011 (7 pages including 3 page English translation).

PCT/EP2011/064659 International Preliminary Report on Patentability dated Mar. 5, 2013 (7 pages).

*Primary Examiner* — Dennis Cordray

(74) *Attorney, Agent, or Firm* — Brinks Gilson & Lione; G. Peter Nichols

(57) ABSTRACT

A method and a device for the dry forming of a fiber web, in which a multiplicity of fibers or fiber mixtures are fed to a forming head by means of an air flow is described. The forming head produces a fiber stream which is introduced into a clearance of a forming zone between the forming head and a laydown belt. To obtain as uniform a construction of the fiber layer as possible during the laying down of the fibers, the fibers of the fiber stream run through the clearance within the forming zone with free sections of different lengths. To this end, the forming head and the laydown belt are held in a non-parallel arrangement, with the result that the clearance is formed by different spacings between the laydown belt and the forming outlet of the forming head.

17 Claims, 2 Drawing Sheets

(56) References Cited

U.S. PATENT DOCUMENTS

| | | | |
|---|---|---|---|
| 5,445,777 | A | 8/1995 | Noel et al. |
| 2004/0231108 | A1 | 11/2004 | Thordahl |
| 2005/0098910 | A1 | 5/2005 | Andersen |
| 2008/0241301 | A1 | 10/2008 | Norgaard et al. |

FOREIGN PATENT DOCUMENTS

| | | |
|---|---|---|
| WO | WO 03/016622 | 2/2003 |
| WO | WO 2004/106604 | 12/2004 |
| WO | WO 2005/106091 | 11/2005 |
| WO | WO 2006/131122 | 12/2006 |

* cited by examiner

METHOD AND DEVICE FOR THE DRY FORMING OF A FIBER WEB

This application is a continuation-in-part of and claims the benefit of priority from PCT application PCT/EP2011/064659 filed Aug. 25, 2011 and German Patent Application DE 10 2010 035 944.0 filed Aug. 31, 2010, the disclosure of each is hereby incorporated by reference in its entirety.

The present invention relates to a method for the dry forming of a fiber web as well as to an apparatus for carrying out the method.

BACKGROUND

It is known for the production of non-woven fabrics that the fibers are laid down to a fiber layer on a laydown belt by means of an air flow. This method, ordinarily described as air laid among experts, is based on the fact that the fibers or fiber mixtures are placed uniformly distributed on the surface of a laydown belt by means of a forming head. The zone covered by the forming head on the laydown belt is ordinarily referred to as a forming zone, in which the fibers meet on the laydown belt. Such a method and device are described in, for example, WO 2004/106604 A1. In the case of the known methods and the known device, a multiplicity of fibers or fiber mixtures is fed to a forming head by means of an air flow. Within the forming head means are provided for mixing and distributing the fibers. On the underside of the forming head a forming outlet is constructed which ordinarily is arranged at a short distance above the laydown belt. In this connection, a clearance is formed between the forming head and the laydown belt, the clearance serving to guide a fiber stream escaping from the forming outlet. The laying down of the fibers on the laydown belt is supported by a suction device which absorbs the air of the fiber stream and conducts it away. The fiber layer forming on the surface of the laydown belt is continuously conveyed via the laydown belt out of the forming zone, so that a fiber layer is formed which is subsequently fed to a further treatment, for example solidification.

Depending on the fiber type and fiber size used in such methods, irregularities can arise in the laying down of the fibers, with the irregularities being referred to as beaching. Such irregularities in the fiber distribution are generally attributed to the fact that the distribution and laying down of the fibers is influenced by secondary air flows from the surroundings which are absorbed from the surroundings into the forming zone via the suction device.

In order to eliminate such irregularities in the laying down of the fibers, it is known for example from WO 2006/131122 A1 to influence the suction flow of the suction device in sub-regions of the forming zone. In the case of the known methods and the known device, a guide plate is assigned on an inflow side of the forming zone of the suction device, with the guide plate influencing the suction flow underneath the laying down belt. It is noted that air turbulence arising through suctioned secondary air from the surroundings on the inflow side of the forming zone is supposed to be prevented. However, as a result of the use of such a guide plate, there are differing suction flows in the forming zone which leads to differing laydown behavior of the fibers within the forming zone.

The phenomenon of beaching also could not be ruled out from other systems, such as those known for example from WO 2003/016622 A1. In this connection, the forming head on the inflow side and the outflow side each have sealing rollers, which are in contact with the surface of the laydown belt or the surface of the fiber layer. As a result, it possible to prevent to a great extent an influx in the secondary air from the surroundings. However, in this connection it is disadvantageous that the fiber layer on the surface of the laydown belt is condensed directly on the outflow side by the sealing roller arranged there.

SUMMARY

Hence, the invention addresses the problem of creating a generic method as well as a generic device for the dry forming of a fiber web with which a high uniformity of fiber distribution can be achieved within the fiber layer.

The invention is based on the understanding that the laying down of the fibers is influenced by a fiber stream transverse to a laydown belt essentially through the reorientation of the fibers from an essentially vertical movement to a horizontal movement defined by the laydown belt. Thus it became apparent to the inventors that the residence time of the fibers until impinging on the laydown belt has an influence on the development of the fiber layer. In this respect the laying down of the fibers and the structure of the fiber layer could be advantageously improved by having the fibers of the fiber stream within the forming zone run through the clearance with free sections of different lengths. In this way zones could be realized in which the fibers had greater latitude for the reorientation through long free sections.

The method variant in which the fibers of a fiber stream produced on an inflow side of the forming zone run through a longer free section than the fibers of the fiber stream produced on an outflow side of the forming zone is particularly advantageous. In addition, the great distance between the forming head and the laydown belt on the inflow side can prevent the turbulence effects caused by the inflowing secondary air. On the other hand, the secondary air can be used in a supporting manner for reorientation and laying down of the fibers.

In order to obtain a uniform modification of the free sections within the forming zone, the method variant is preferably used in which case the fiber stream is produced by a forming head inclined vis-à-vis the laydown belt, wherein the free sections of the fibers within the clearance between the inflow side and the outflow side are continuously changing. With this arrangement it is possible to make advantageous use of a horizontally aligned laydown belt for receiving and development of the fiber layer, so that a redistribution of the fibers in the fiber layer cannot occur during transport on an inclined laydown belt.

In order to suppress counter-effects through other secondary air flows within the forming zone, the method variant is particular advantageous in which case the clearance of the forming zone on the outflow side for guiding the fibers is screened by at least one screening means vis-à-vis the surroundings.

In contrast, the clearance of the forming zone on the inflow side for guiding the fibers to the surroundings is kept open. With this, a secondary air flow can be deliberately produced which acts in the direction of the material flow of the laydown belt. Thus, advantageous pre-orientations can be produced on the fiber stream in the direction of the material flow.

In order to be able to generate a uniform fiber layer over the entire width of the laydown belt, in accordance with an advantageous improvement of the inventive method, provision is made that the clearance of the forming zone between the inflow side and the outflow side for guiding the fibers to the surroundings is kept closed. In this way secondary air flows occurring on the long side of the laydown belt can be prevented.

For carrying out of the inventive method in the case of the inventive device the forming head and the laydown belt are kept in a non-parallel arrangement, so that the clearance is formed by differing distances between the laydown belt and the forming outlet of the forming head.

In this connection, the arrangement of the forming head and of the laydown belt is preferably constructed in such a way that the distance between the laydown belt and the forming outlet of the forming head on an inflow side of the forming zone is greater than distance between the laydown belt and the forming outlet of the forming head on an outflow side of the forming zone. In addition, the larger free section for reorientation is realized in the inflow region of the forming zone.

The forming head is preferably held on a inclined plane vis-à-vis the laydown belt so that the distance between the laydown belt and the forming outlet of the forming head from the inflow side to the outflow side of the forming zone is continually changing. With this, a continuous reduction of the free section in the direction of the material flow of the laydown belt can be achieved. Thus, the reduced suction effect due to the already formed fiber layers toward the outflow side of the forming zone can be compensated. The fibers can be received with essentially the same kinetic energy on the surface of the laydown belt or of the fiber layer.

In order to obtain a setting of the free sections in the forming zone optimized for formation of the fiber layer dependent on the fibers and fiber mixtures, the forming head is advantageously held by an adjustable retainer, as a result of which the degree and/or the height of the inclined plane of the forming head can be set.

In order to suppress as much as possible the entry of secondary air on the outflow side, two alternative device variants of the inventive device can be employed. In the case of a first variant, at least one screening means is arranged on the outflow side of the forming head, through which the clearance can be screened vis-à-vis the surroundings. Such screening means are preferably formed by driven sealing rollers which are held in contact with a fiber layer on the laydown belt. This variant is however only suitable when a pre-compression of the fiber layer on the surface of the laydown belt is harmless for any further processing.

For sensitive fiber layers, the device variant is preferably implemented in which case an outflow opening is formed on the outflow side of the forming zone between the forming head and the laydown belt. Such outflow openings are preferably implemented with a small gap height which, depending on the thickness of the fiber layer, can range from 4 mm to 20 mm.

In order to be able to use the secondary flow of ambient air necessary for reorientation, the inventive device is preferably constructed in such a way that an inflow opening is formed on the inflow side of the forming zone between the forming head and the laydown belt.

In this connection, the inflow opening is preferably constructed with a gap height ranging between 40 mm to 400 mm. Thus, preferably laminar secondary flows of the ambient air can be introduced into the forming zone.

The peripheral regions of the forming zone are preferably sealed in accordance with the advantageous improvement of the invention, wherein the clearance to both long sides of the laydown belt vis-à-vis the surroundings is sealed by sealing means between the forming head and the laydown belt. Thus, a uniform fiber layer can be produced over the entire width of the laydown belt.

The fiber stream is preferably produced at the forming outlet of the forming head through a perforated plate or stressed screen cloth, which makes possible a homogenized distribution of the fibers over the entire forming zone.

The inventive method and the inventive device are suitable for the laying down of all fibers and fiber mixtures. For example, synthetic and natural fibers or mixtures of synthetic and natural fibers can be laid down to fiber layers. Due to the high uniformity of the produced fiber layer in the process, preferably even the finest parts such as for example a powder can be advantageously integrated into the mixture.

The inventive method will be explained in more detail with the help of some exemplary embodiments of the inventive device making reference to the attached figures.

DETAILED DESCRIPTION

Figure 1:
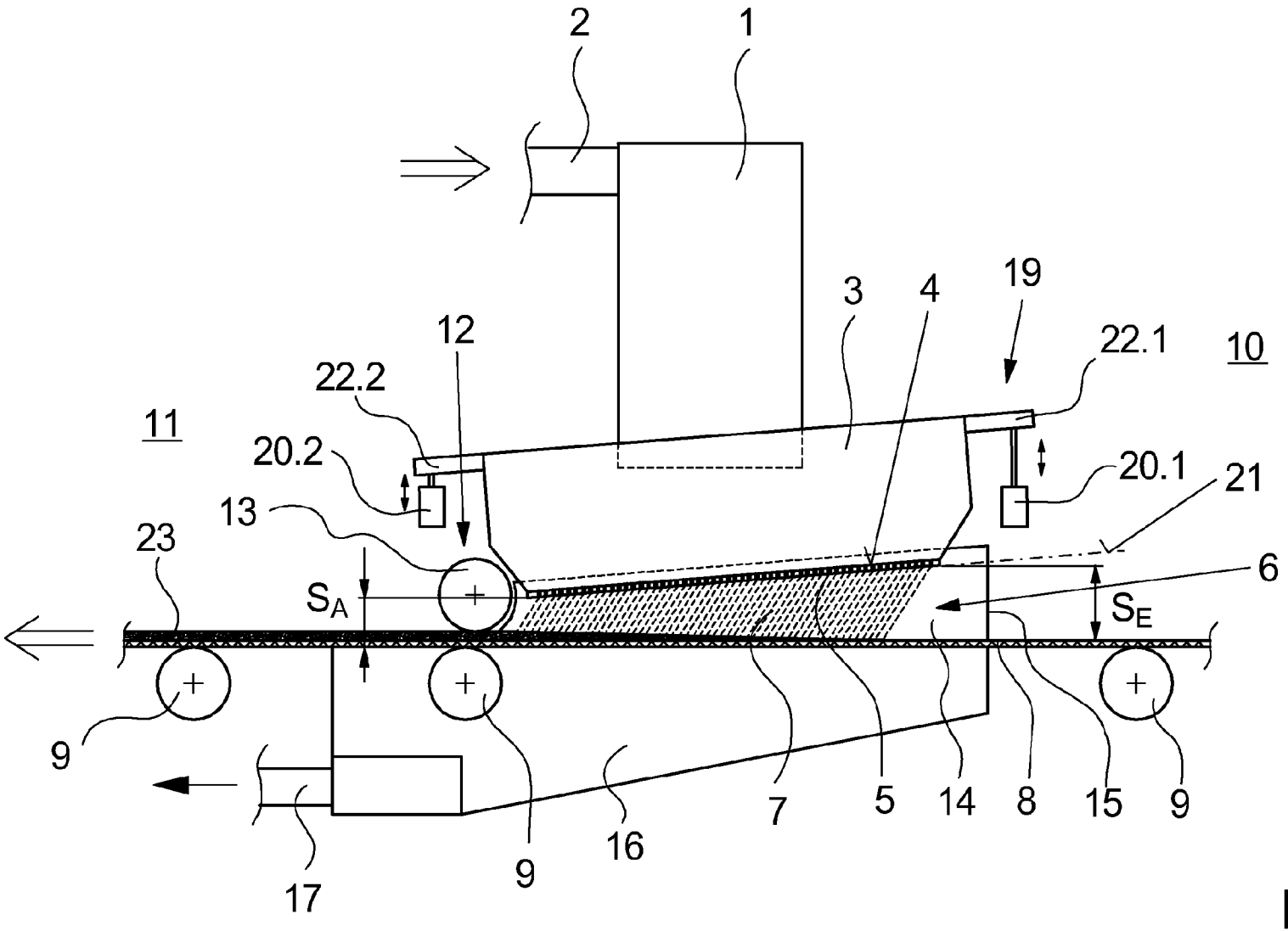
FIG. 1 shows schematically a cross-section view of a first exemplary embodiment of the inventive device for carrying out the inventive method.

FIG. 1 shows schematically a first exemplary embodiment of the inventive device for carrying out the inventive method. The exemplary embodiment shows a mixing chamber 1 that is connected via a fiber inlet 2 to a fiber feed not shown in the figure. The fiber inlet 2 can contain one or more connections in order to feed one or more fibers or fiber mixtures by means of an air flow of the mixing chamber 1. The mixing chamber 1 is connected on an underside to a forming head 3. The forming head 3 includes several means (not shown in detail here) to uniformly distribute the fibers or fiber mixtures and conduct them away as a fiber stream via a forming outlet 4 constructed on the underside. The forming outlet 4 preferably includes a perforated plate 5. In the process, the distribution takes place within the forming head preferably via several driven wings, such as is known for example from WO 2004/106604. In this respect, WO 2004/106604 is incorporated herein by reference.

The forming head 3 is arranged above a laydown belt 8 at an inclined plane 21. The laydown belt 8 is essentially horizontally aligned, so that on an inflow side 10 a greater distance between the forming head 3 and the laydown belt 8 is set than on the opposing outflow side 11. The distance to the inflow side 10 is marked with the identification letters letter $S_E$. In contrast the distance between the forming outlet 4 and the laydown belt 8 is marked with the identification letters $S_A$.

The location of the forming head 3 or the location of the inclined plane 21 can be set via a retainer 19 of the forming head 3. The retainer 19 is in this exemplary embodiment formed by two actuators 20.1 and 20.2, each of which engages on support arm 22.1 and 22.2, with the support arms being connected to the forming head 3. Thus, through a parallel actuation of the actuators 20.1 and 20.2 the height of the forming head can be set relative to the laydown belt 8 and thus the height of the inclined plane 21. By means of unilateral actuation of the actuators 20.1 or 20.2 it is possible to set the angular position of the forming head 3 and with it the degree of the inclined plane 21 relative to the laydown belt 8. In each case, a modification of the distances between the forming outlet 4 and the laydown belt 8 occurs.

The laydown belt 8 is gas permeable and is continuously fed in a material conveying direction via several guide rollers 9, with the material conveying direction being identified by a double arrow. In this respect, the laydown belt 8 continuously runs through the forming zone 6 from the inflow side 10 to the outflow side 11. In the process, the fibers are laid down on the surface of the laydown belt 8 to a fiber layer 23.

Below the laydown belt, a suction device 16 is arranged with the suction device being connected via a suction channel 17 to a vacuum source not shown in the figure.

The forming outlet 4 of the forming head 3 is in this case rectangularly constructed, so that an essentially rectangular forming zone 6 is constructed above the laydown belt 8. The clearance 7 of the forming zone 6 is in this exemplary embodiment only connected to the surroundings via an inflow opening 14 on the inflow side 10. On the opposing outflow side 11, a screening means 12 in the form of a sealing roller 13 is arranged between the forming head 3 and the laydown belt 8. The absorption of secondary air from the surroundings can be prevented in this way. In addition, in the region of the long sides of the forming head 3, there are two opposing separating plates 15 provided, which seal the clearance 7 of the forming zone 6 to both long sides of the laydown belt 8 vis-à-vis the surroundings.

In the case of the exemplary embodiment of the inventive device shown in FIG. 1, a synthetic fiber, for example, is fed with a powder jointly via an air flow of the mixing chamber 1. Within the mixing chamber 1, static or dynamic means can be constructed, which implement a premixing of the fibers. Subsequently, the mixture of fiber and powder is guided via the air flow to the forming head 3. Within the forming head 3, a distribution of the fiber and powder mixture takes place via the distribution means, with the mixture then being guided as a fiber stream into the clearance 7 via the forming outlet 4. Within the forming zone 6, a continuously active suction flow is generated via the suction device 16, with the suction flow on the one hand collecting the fibers entering into the clearance 7 and on the other hand generating a secondary air flow from the surroundings on the inflow side 10. In the guiding of the fibers within the clearance 7, the fibers of the fiber stream in the region of the inflow side 10 run through a longer free section until being laid down on the laydown belt 8. By way of contrast, the fibers on the opposing outflow side 11 are guided on a shorter free section. Thus the fibers guided in the region of the inflow side 10 receive a higher residence time in order to execute the transition from a vertically oriented movement to a horizontally oriented movement. Thus, the fibers can be laid down by the influence of a secondary air flow on the inflow side with a slight pre-orientation in material flow direction. This turns out to be particularly advantageous in particular in the formation of a uniform fiber layer 23.

Depending on the fiber type and fiber mixtures, it turns out that the distance $S_E$ on the inflow side 10 for formation of the inflow opening 14 should be in a range from 40 mm to 400 mm. Too small a distance between the forming head 3 and the laydown belt 8 has the disadvantage that the absorbed secondary air leads to severe turbulence. Too great a distance between the forming head 3 and the laydown belt 8 on the inflow side 10 increasingly reduces the influence of the secondary air, so that this should likewise be avoided.

On the opposing outflow side 11 of the forming head 3 the absorption of a secondary air is prevented by the sealing roller 13. In this respect, only the influence of the secondary air permitted via the inflow opening 14 remains, with the secondary air being able to be used purposefully for the improvement of the fiber layers.

The inventive method and the inventive device are thus particularly well suited for achieving a high uniformity in the production of fiber layers that are formed of a multiplicity of single finite fiber pieces. In this connection, synthetic or natural fibers or mixtures of synthetic and natural fibers can be laid.

Figure 2:
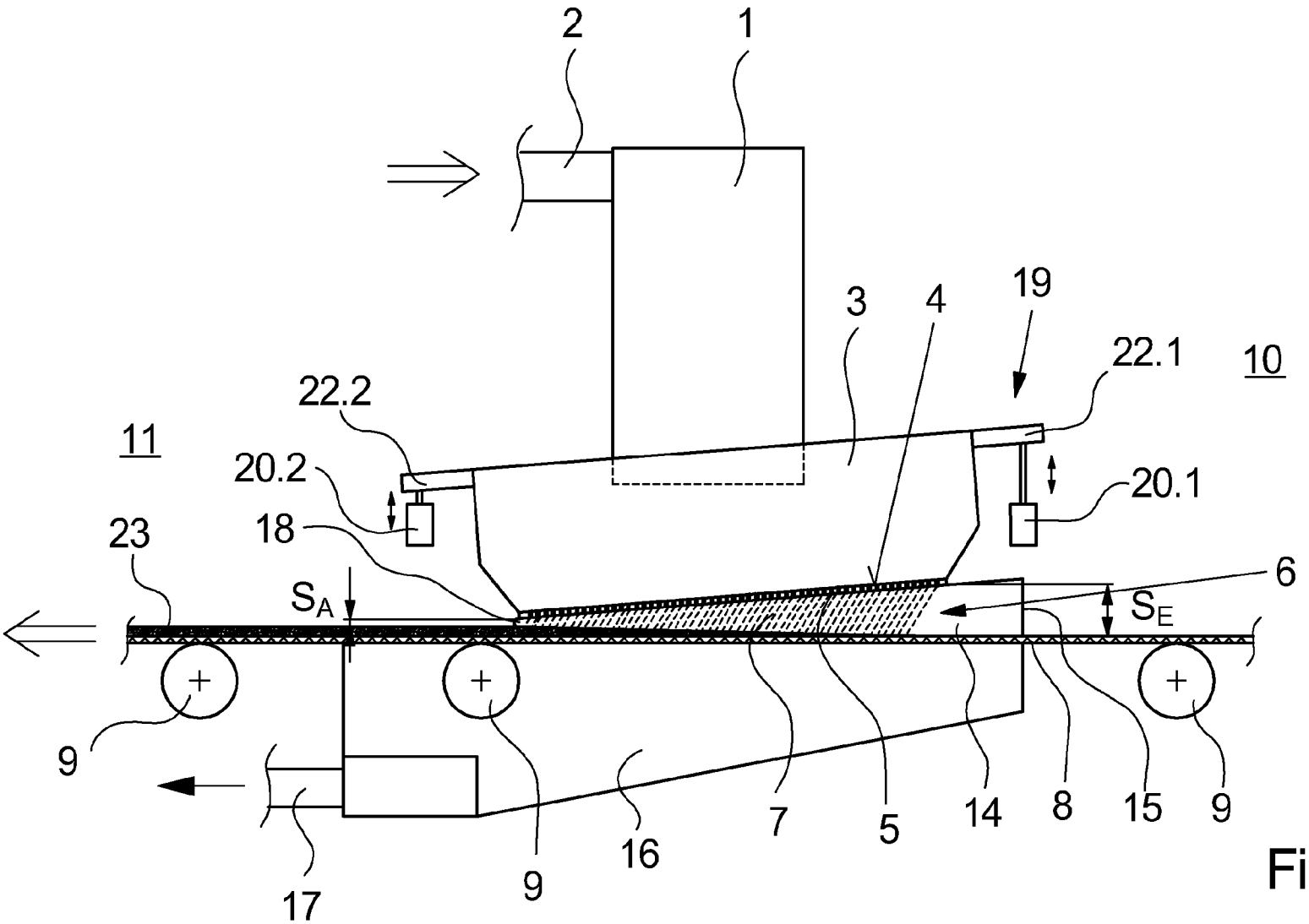
FIG. 2 shows schematically a cross-section view of a further exemplary embodiment of the inventive device for carrying out the inventive method.

FIG. 2 shows a further exemplary embodiment of the inventive device for carrying out the inventive method. The exemplary embodiment of the inventive device shown in FIG. 2 is essentially identical to the exemplary embodiment in accordance with FIG. 1, so that only the differences will be explained here and otherwise reference is made to the aforementioned description.

In the exemplary embodiment shown in FIG. 2, the forming head 3 is likewise held on an inclined plane vis-à-vis the laydown belt 8, so that on the inflow side 10 a greater distance arises between the forming outlet 4 and the laydown belt 8 than vis-à-vis the outflow side 11. The distance on the inflow side is marked with the identification letter $S_E$ and on the outflow side with the identification letter $S_A$. In this connection, on the outflow side 11 between the forming head 3 and the laydown belt 8 an outflow opening 18 is formed, which connects the clearance 7 of the forming zone 6 to the surroundings. Likewise, on the opposing inflow side 10, an open inflow opening 14 is shown that is likewise connected to the surroundings. However, through the inclined arrangement of the forming head 3 the outflow opening 18 a significantly lower gap height than the opposing inflow opening 14 is provided. Thus, depending on the fiber and fiber type, the outflow opening 18 is constructed in such a way that a distance in the magnitude of 4 mm to 20 mm ensues between the forming outlet 4 and the laydown belt 8. The gap height of the outflow opening 18 is arranged or set in the process essentially to the thickness of the fiber layer which is produced on the surface of the laydown belt.

For the setting of the inflow opening 14 and the outflow opening 18, the forming head 3 is likewise adjustable via an adjustable retainer 19. The retainer 19 is in this connection identical to the aforementioned exemplary embodiment, so that no further explanation will be given here.

In the exemplary embodiment of the inventive device shown in FIG. 2, the forming zone and thus the clearance 7 are only screened from the surroundings by the separating plates 15 arranged on the long sides. No additional screening means are provided on either the inflow side 10 or the outflow side 11.

In the exemplary embodiment shown in FIG. 2, the fibers within the fiber stream are likewise guided in free sections of differing length within the clearance, so that the residence times for running through the free sections in the inflow region of the forming zone are greater than in the outflow region. In this connection, in this respect the secondary air effects can be used jointly in order to obtain a favorable reorientation of the movement sequences in single fibers. Through the narrow gap on the outflow side it is possible to minimize the absorbed secondary air so that undesired disturbing effects can be avoided.

The above disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description. While various embodiments of the invention have been described, it will be apparent to those of ordinary skill in the art that many more embodiments and implementations are possible within the scope of the invention. Accordingly, the invention is not to be restricted except in light of the attached claims and their equivalents

REFERENCE LIST

1 Mixing chamber
2 Fiber inlet
3 Forming head
4 Forming outlet
5 Perforated plate
6 Forming zone
7 Clearance
8 Laydown belt
9 Guide rollers
10 Inflow side
11 Outflow side
12 Screening means
13 Sealing roller
14 Inflow opening
15 Separating plate
16 Suction device
17 Suction channel
18 Outflow opening
19 Retainer
20.1, 20.2 Actuator
21 Inclined plane
22.1, 22.2 Support arm
23 Fiber layer
Distance $S_E$, $S_A$

The invention claimed is:

1. A method for the dry forming of a fiber layer comprising:

a. feeding a multiplicity of fibers or fiber mixtures to a forming head by means of an air flow to produce a fiber stream;

b. introducing the fiber stream into a free space of a forming zone, wherein the free space is formed between the forming head and an air permeable laydown belt that runs through the forming zone from an inflow side to an outflow side;

c. intercepting the fibers of the fiber stream by the air permeable laydown belt to form a fiber layer on an upper side of the laydown belt, wherein the air on an underside of the laydown belt is suctioned; and, d. conveying the fiber layer from the forming zone, wherein the fibers of the fiber stream within the forming zone run through the free space with routes of differing length, wherein the free space of the forming zone on the inflow side is kept open to the surroundings for guiding the fibers.

2. The method according to claim 1, wherein the fibers of the fiber stream introduced on the inflow side of the forming zone run through a longer route than the fibers of the fiber stream introduced on the outflow side of the forming zone.

3. The method according to claim 2, wherein the forming head is inclined vis-à-vis the laydown belt and wherein the routes of the fibers within the free space continuously change between the inflow side and the outflow side.

4. The method according to claim 1, wherein the free space of the forming zone on the outflow side is screened vis-à-vis the surroundings.

5. The method according to claim 1, wherein the free space of the forming zone between the inflow side and the outflow side is kept closed on both sides of the laydown belt.

6. A device for the dry forming of a fiber layer comprising:

a. a forming head to which a multiplicity of fibers or fiber mixtures can be fed by means of an air flow and which includes a forming outlet to produce a fiber stream formed of fibers and air, b. an air permeable laydown belt for collecting and transporting the fibers of the fiber stream as a fiber layer, wherein the air permeable laydown belt runs through a forming zone from an inflow side to an outflow side;

c. a suction device for production of a suction flow through the laydown belt;

d. a forming zone with a free space formed between the forming outlet of the forming head and the laydown belt, wherein the forming head and the laydown belt are held in a non-parallel arrangement so that the free space is formed by differing distances between the laydown belt and the forming outlet of the forming head and wherein the free space of the forming zone on the inflow side is kept open to the surroundings for guiding the fibers.

7. The device according to claim 6, wherein the distance between the laydown belt and the forming outlet of the forming head on the inflow side of the forming zone is greater than the distance between the laydown belt and the forming outlet of the forming head on the outflow side of the forming zone.

8. The device according to claim 6, wherein the forming head is arranged to be at an inclined plane vis-à-vis the laydown belt so that the distance between the laydown belt and the forming outlet of the forming head from the inflow side to the outflow side of the forming zone continuously changes.

9. The device according to claim 8, further comprising an adjustable retainer cooperating with the forming head, to adjustably set at least one of an inclination or height of the inclined plane relative to the laydown belt.

10. The device according to claim 6, further comprising at least one screening means arranged on the outflow side of the forming zone, through which the free space can be screened vis-à-vis the surroundings.

11. The device according to claim 10, wherein the screening means is formed by a driving sealing roller that is in contact with the fiber layer on the laydown belt.

12. The device according to claim 6, further comprising an outflow opening arranged at an outflow side of the forming zone between the forming head and the laydown belt.

13. The device according to claim 12, wherein the outflow opening provides a gap height in the range from about 4 mm to about 20 mm, wherein the gap height is a distance between the forming head and the laydown belt.

14. The device according to claim 6, further comprising an inflow opening arranged at the inflow side of the forming zone between the forming head and the laydown belt.

15. The device according to claim 14, wherein the inflow opening provides a gap height in the range of about 40 mm to about 400 mm, wherein the gap height is a distance between the forming head and the laydown belt.

16. The device according to claim 6, wherein the laydown belt includes two long sides perpendicular to a material conveying direction of the laydown belt and wherein the free space to both long sides of the laydown belt is sealed vis-à-vis the surroundings by sealing means between the forming head and the laydown belt.

17. The device according to claim 6, wherein the forming outlet of the forming head includes a perforated plate.

* * * * *